United States Patent [19]

Biller et al.

[11] 4,109,227

[45] Aug. 22, 1978

[54] CONTACT ASSEMBLY FOR HIGH VOLTAGE FUSE

[75] Inventors: Bruce A. Biller, Chicago; Henry W. Scherer, Mt. Prospect, both of Ill.

[73] Assignee: S&C Electric Company, Chicago, Ill.

[21] Appl. No.: 741,028

[22] Filed: Nov. 11, 1976

[51] Int. Cl.[2] ..... H01H 85/16

[52] U.S. Cl. ..... 337/252; 337/253; 337/413

[58] Field of Search ..... 337/180, 181, 251, 252, 337/253, 413, 168, 171; 339/276 T; 29/517

[56] References Cited

U.S. PATENT DOCUMENTS

| | | | |
|---|---|---|---|
| 2,289,207 | 7/1942 | Papp | 337/253 X |
| 2,325,540 | 7/1943 | Pittman et al. | 337/252 X |
| 3,855,563 | 12/1974 | Cameron et al. | 337/190 X |

*Primary Examiner*—George Harris
*Attorney, Agent, or Firm*—Kirkland & Ellis

[57] ABSTRACT

In a high voltage expulsion type fuse, a fusible element is connected between an arcing rod and a contact element. The arcing rod is biased for movement by a spring, and when the fuse is assembled, the contact element is pulled through the fuse compressing the spring until the contact element is pulled partially through an opening in a contact bridge which is threaded into the metal exhaust ferrule of the fuse. Once the contact element is in the correct position, the bridge is swaged to attach the element to the bridge. The element has tapered grooves at the end that is inserted into the bridge so that when the bridge is swaged, the tapered grooves tend to force the contact element further into the opening so that a shoulder on the element remains firmly against the bridge. A threaded member attached to the end of the element may be engaged to pull the element through the bridge. After the bridge has been swaged, the thread member is broken off since it is no longer needed.

12 Claims, 7 Drawing Figures

10
40
42
44
46
48
50
52
54
56
58
60
62
64
66
68
70
72
74
76
78
80
82
84
86
88
90
100
102
104
105
118
119
120
122
128
130
132
A
7

CONTACT ASSEMBLY FOR HIGH VOLTAGE FUSE

BACKGROUND OF THE INVENTION

1. Field of the Invention

The present invention relates to contact assemblies for high voltage fuses, and more particularly, to contact elements and methods of assembly thereof in high voltage expulsion type fuses.

2. Description of the Prior Art

High voltage explusion fuses are well known in the art as exemplified by such patents as U.S. Pat. Nos. 3,267,235 — Barta, 3,176,100 — Barta, 3,575,683 — Fahnoe, and 3,855,563 — Cameron et al. The prior art expulsion fuses disclosed in the foregoing patents all utilize an arcing rod biased by a spring for a movement but which is retained against movement by a fusible element and a strain wire which are connected between one end of the arcing rod and some type of contact assembly. For example, in U.S. Pat. No. 3,176,100 — Barta, the contact assembly comprises a stud mounted to the wall of a metal exhaust ferrule. In U.S. Pat. No. 3,575,683 — Barta, the contact assembly comprises a terminal stud mounted to a bridging member which forms an integral part of an exhaust ferrule. In U.S. Pat No. 3,267,235 — Barta the contact assembly comprises a bridge attached to the interior wall of the ferrule by soldering, brazing or some other similar technique, and a terminal rod which is bolted to the bridge. Finally, U.S. Pat. No. 3,855,563 — Cameron et al. does not utilize a contact assembly as such, but merely folds the strain wire and fusible element over the edge of the insulator tube and crimps these elements with a metal ferrule. This latter technique is not particularly desirable since the fusible element and strain wire can easily become weakened or broken during the crimping operation or subsequent handling.

The present invention, as will be more fully described and disclosed herein, provides a contact assembly which is easily assembled, permits reliable positioning, remains in position during fuse operation, and resists burning out during fuse operation. Thus, the present invention is a desirable advance in the existing art.

BRIEF DESCRIPTION OF THE INVENTION

A contact assembly for a high voltage fuse in accordance with the present invention comprises a contact bridge having center portion with an opening therethrough. The contact bridge includes arms projecting outwardly from the center portion with means on the end of the arms for engaging the interior of the fuse to retain the contact bridge in a fixed position. A contact element having a first end dimensioned to fit into the opening in the center portion is inserted into the opening and attached to the bridge by swaging. The contact element has a second end extending from the contact bridge and a fusible element is connected to the second end of the contact element.

The contact element can further comprise a shoulder positioned intermediate the first and second ends dimensioned to be larger than the opening in the center portion of the bridge so that the shoulder will engage the center portion when the first end is positioned in the opening. The contact element also has at least one groove formed adjacent the first end having a tapered surface adapted to cause the shoulder to be drawn against the center portion when the bridge is swaged.

The contact element can also include a threaded member formed on the first end of the contact element adapted to be engaged to position the contact element in the contact bridge before swaging and also adapted to be broken off once the contact element was swaged to the contact bridge.

Thus, it is a principal object of the present invention to provide a contact assembly for a high voltage fuse which permits economical assembly by swaging and assures reliable operation.

Yet another object of the present invention is to provide a contact assembly for a high voltage fuse which can be threaded into position without the necessity for brazing or soldering operations.

Yet another object of the present invention is to provide a contact assembly for a high voltage fuse which reliably positions the fusible element and the arcing rod with respect to the arc extinguishing material in the fuse.

These and other objects, advantages, and features of the present invention shall hereinafter appear, and for the purposes of illustration, but not for limitation, an exemplary embodiment of the present invention is illustrated in the accompanying drawings.

DETAILED DESCRIPTION OF THE PREFERRED EMBODIMENT

Figure 1:
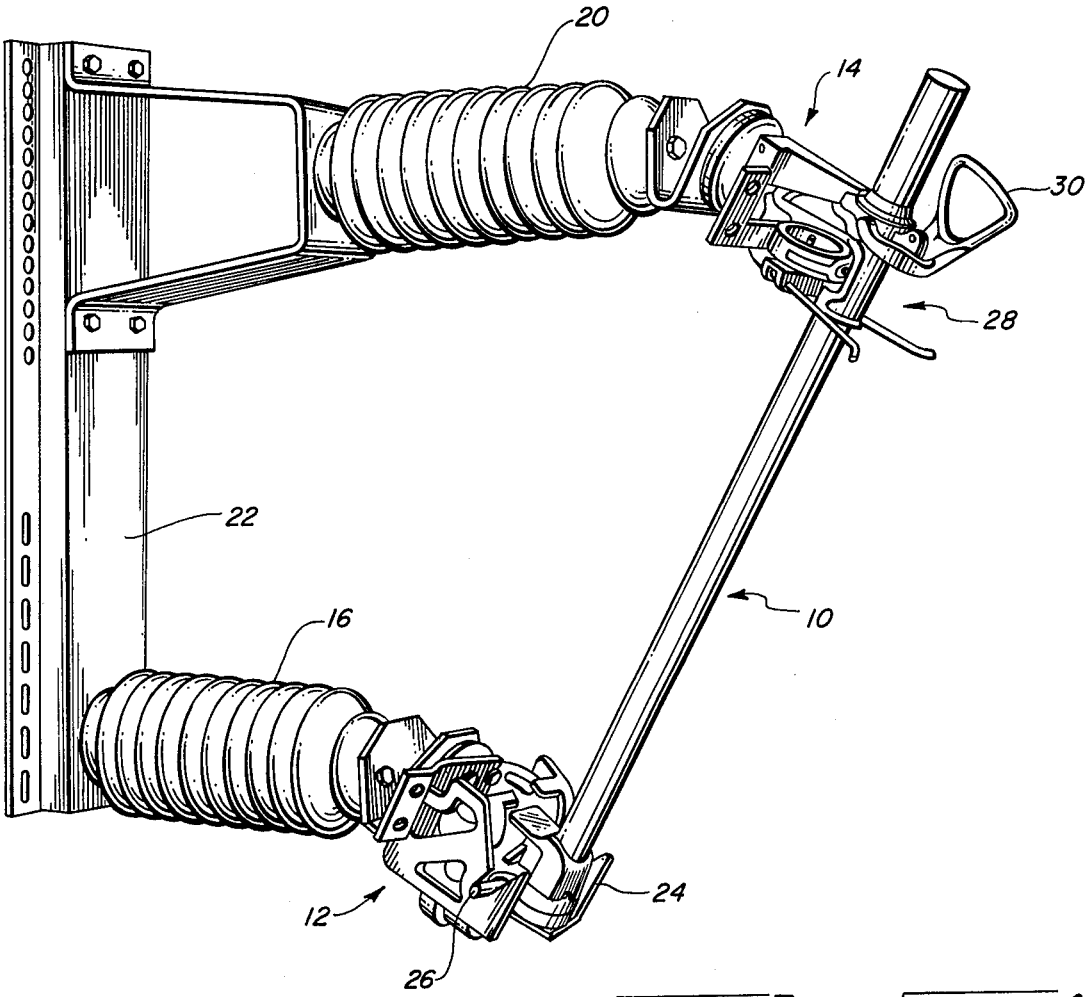
FIG. 1 is a perspective view of a high voltage fuse of the type in which the present invention may be utilized.

With reference to FIG. 1, a fuse 10 of the dropout expulsion type is shown mounted between a lower mounting terminal 12 and an upper mounting terminal 14. Terminals 12 and 14 are respectively mounted to the ends of insulators 16 and 20 which are respectively mounted to a supporting structure 22.

Mounted on the end of the fuse 10 is a trunnion assembly 24 which includes a pin 26 which rides in a groove in lower mounting terminal 12 so that fuse 10 is pivotably mounted and can pivot around pin 26. Mounted on the other end of fuse 10 is a fuse release assembly 28 which is designed and adapted to engage upper mounting terminal 14 and to disengage upper mounting 14 when hook ring 30 is pulled by an insulated hook stick or when the fuse operates. The exact operation of fuse release assembly 28 is well known in the art and does not form a part of the present invention.

Figures 2, 6, 7:
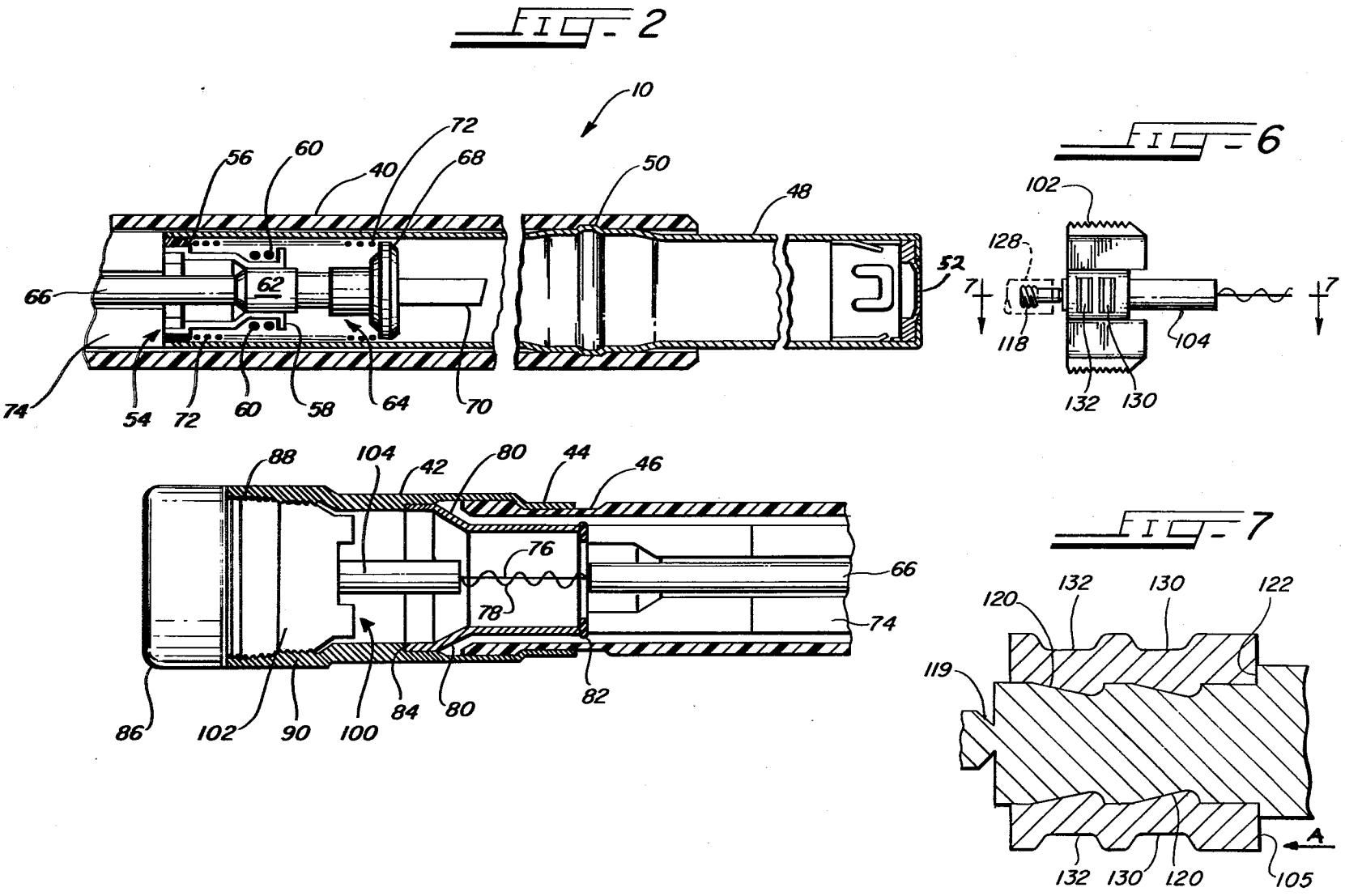
FIG. 2 is a cross-sectional, partially fragmentary view of a high voltage fuse having the present invention mounted therein.
FIG. 6 is a side view of an assembled contact element in accordance with the present invention.
FIG. 7 is a cross-sectional, partially fragmentary view taken approximately along line 7—7 in FIG. 6.

With reference to FIG. 2, fuse 10 comprises a tubular insulator housing 40 having a metallic exhaust ferrule 42 mounted to one end thereof by compressing an end 44 of ferrule 42 into a groove 46 around the end of insulator housing 40. Mounted in the opposite end of insulator housing 40 is conducting tube 48. Tube 48 is attached to insulator housing 40 by expanding a portion of tube 48 into a groove 50 formed on the interior surface of housing 40 in the manner described in co-pending application Ser. No. 741,026 filed Nov. 11, 1976, now U.S. Pat. No. 4,075,755 and assigned to the same assignee as the present invention Mounted in the end of tube 48 is a sealing arrangement 52 which provides a moisture impervious seal at the end of fuse 10. Mounted in the opposite end of tube 48 is a contact assembly 54 which comprises a flange portion 56 which engages the end of tube 48, and a plurality of contact fingers 58 which are biased towards one another by garter springs 60 to engage a contact 62 of contact button assembly 64 mounted on the end of arcing rod 66. Contact button assembly 64 also comprises a button flange 68 and a striker pin 70. A spring 72 is compressed between button flange 68 and flange portion 56 biasing arcing rod 66 toward movement to the right as viewed in FIG. 2. Arcing rod 66 extends through a hollow opening through a stack of cakes of arc extinguishing material 74. Connected to the end of arcing rod 66 is a strain wire 76 and a fusible element 78. Strain wire 76 may be fabricated from any relatively strong material such as nickel-chrome alloy, and fusible element 78 is typically fabricated from a silver alloy. Positioned around strain wire 76 and fusible element 78 is an exhaust tube 80 that is positioned between an annular seal 82 against arc extinguishing material 74 and a shoulder 84 formed on the interior of ferrule 42. Mounted over the open end of ferrule 42 is a rain cap assembly 86 which does not form a part of the present invention and may take the form of rain cap more fully described in co-pending patent application Ser. No. 609,599, filed Sept. 2, 1975, now issued as U.S Pat. No. 4,001,750, and assigned to the same assignee as the present invention.

Formed on the interior surface of exhaust ferrule 42 are a first set of threads 88 of a diameter suitable for attaching rain cap assembly 86. Also formed on the interior of exhaust ferrule 42 are a second set of threads 90 having a slightly smaller diameter than first threads 88. Mounted in the interior of exhaust ferrule 42 on threads 90 is a contact assembly 100 which comprises a contact bridge 102 and a contact element 104 which extends from contact bridge 102 in a cantilever fashion. Connected to an end of contact element 104 is strain wire 76 and fusible element 78. Thus, an electrical circuit is completed through exhaust ferrule 42, contact bridge 102, contact element 104, strain wire 76 and fusible element 78, arcing rod 66, contact 62, contact assembly 54, and conducting tube 48.

As is well known in the art, strain wire 76 and fusible element 78 will melt when excessive currents are conducted, thus releasing arcing rod 66 so that it will move rapidly through tube 48 under the biasing of spring 72. As arcing rod 66 is drawn through the hollow exterior of arc extinguishing material 74, the resultant arc is extinguished causing current interruption.

However, to assure that fuse 10 properly conducts electrical current during normal operations, it is necessary for a proper electrical connection to be provided between all of the conducting components. Further, it is necessary for the arcing rod to be properly positioned with the fuse especially in the center of the hollow opening in the arc extinguishing material 74 to assure proper operation.

Figure 3:
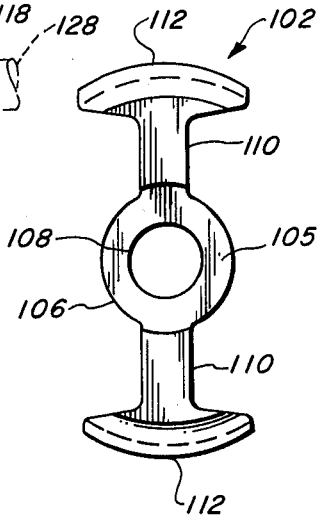
FIG. 3 is a front view of a contact bridge in accordance with the present invention.
Figure 4:
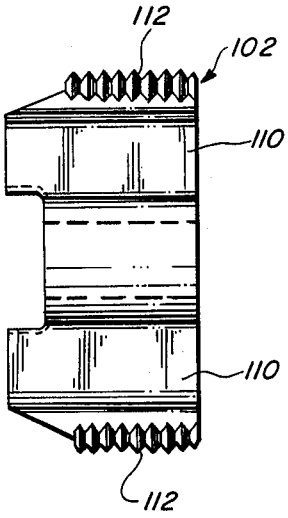
FIG. 4 is a side view of the contact bridge illustrated in FIG. 3.

With reference to FIGS. 3 and 4, contact bridge 102 comprises a center portion 106 which is essentially cylindrical in shape having a circular opening 108 through the center portion 106 essentially along its cylindrical axis. Extending from center portion 106 are arms 110. Formed on the end of arm 110 are threads 112 which are dimensioned to mate with threads 90 on the interior of ferrule 42.

Figure 5:
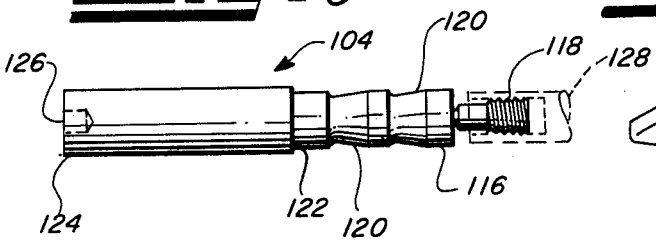
FIG. 5 is a side view of a contact element in accordance with the present invention.

With reference to FIG. 5, contact element 104 comprises a first end 116 that has a guide member 118 attached thereto. The purpose of guide member 118 will be described in more detail later. Also formed adjacent first end 116 are tapered grooves 120 that are slanted such that the grooves are deeper towards the side closest to a shoulder 122 formed on contact element 104 intermediate the first end 116 and a second end 124. Second end 124 has a recess 126 formed therein to assist in the attachment of strain wire 76 and fusible element 78 to the end of contact element 104.

With reference to FIGS. 6 and 7, the method of assembly of contact bridge 102 and contact element 104 is illustrated. During assembly, fusible element 78 and strain wire 76 are connected, such as by brazing, to the end of arcing rod 66 and to the end of contact element 104. Contact button assembly 64 is also connected to the other end of arcing rod 66. Conducting tube 48 is connected to one end of insulator tube 40, and ferrule 42 is connected to the other end of insulator tube 40 with exhaust tube 80 and arc extinguishing material 74 positioned within insulator tube 40. Bridge 102 is then screwed into the interior of ferrule 42 and a long cylindrical tool is inserted through the circular opening 108 in bridge 102 through the hollow opening in the arc extinguishing material and out through the end of tube 48. The cylindrical tool is adapted to engage serrations or threads on guide member 118 and is generally designated by the dotted lines 128 in FIGS. 5 and 6. The assembled combination of the arcing rod 66, contact button assembly 64, fusible element 78, strain wire 76, and contact element 104 is drawn through the fuse compressing spring 72 until the first end 116 of contact element 104 is pulled through the circular opening 108 in bridge 102, and shoulder 122 rests against the flat surface 105 of bridge 102.

When in this position, the center portion 106 of bridge 102 is swaged by compressing the center portion 106 as indicated at two points 130 and 132 on each side of the center portion 106 in the region of grooves 120 adjacent first end 116. The swaging causes the wall of center portion to be crushed or extruded into the grooves 120 securely holdng element 104 in bridge 102.

With reference to FIG. 7, it can be seen that when swaging of bridge 102 and element contact 104 is accomplished, the wall of the center portion is forced against the tapered surface of grooves 120 which tends to cause contact element 104 to be forced in the direction of arrow A in FIG. 7. This tends to cause shoulder 122 to be pulled tightly against surface 105 of bridge 102 so that contact element 104 is firmly held to bridge 102. After the swaging operation has been completed, guide member 118 which has a necked-down portion 119 (see FIG. 7) can be broken off since it is no longer needed.

The swaging operation described herein also has an additional benefit. When bridge 102 is swaged, it tends to be expanded slightly in a radial direction so that threads 112 are tightly forced against threads 90 in ferrule 42. This improves the electrical connection between the bridge 102 and the ferrule 42 thereby enhancing current conduction, as well as preventing bridge 102 from rotating after swaging.

It has been discovered that if tapered grooves 120 are not provided on contact element 104, deformation of element 104 during swaging causes shoulder 122 to move away from flat surface 105 as viewed in FIG. 7. This is objectionable since it is highly desirable to maintain dimension control of all of the elements of the fuse as well as to maintain a firm, tight connection between bridge 102 and contact element 104.

It should be apparent to one skilled in the art, that various modifications, alterations, or changes can be made to the preferred embodiment illustrated herein without departing from the spirit and scope of the present invention as defined in the appended claims.

We claim:

1. A contact assembly for a high voltage fuse comprising:

a contact bridge having center portion with an opening through the center portion, said contact bridge including arms projecting outwardly from the center portion, said arms having means for engaging the interior of the fuse to retain the contact bridge in a fixed position;

a contact element having a first end dimensioned to fit into said opening in said center portion, said contact element being attached to said bridge by swaging, said contact element having a second end extending from said contact bridge, said second end being connected to a fusible member within the fuse.

2. A contact assembly, as claimed in claim 1, wherein said contact element further comprises a shoulder positioned intermediate the first and second ends, said shoulder dimensioned larger than said opening in said center portion so that said shoulder will engage said center portion when said first end is positioned in said opening.

3. A contact assembly, as claimed in claim 2, wherein said contact element has at least one groove formed adjacent the first end, said groove having a tapered surface adapted to cause said shoulder to be drawn against said center portion when said bridge is swaged.

4. A contact assembly, as claimed in claim 1, wherein said contact assembly further comprises a guide member formed on the first end of said contact element, said guide member being adapted to be engaged to position said contact element in said opening in said contact bridge before swaging and to be broken off once said contact element is swaged to said contact bridge.

5. A contact assembly, as claimed in claim 1, wherein said means for engaging the interior of the fuse comprises threads formed on projecting ends of said arms which engage mating threads on the interior of the fuse.

6. In a high voltage fuse including a hollow insulator tube, a hollow metal exhaust ferrule attached to one end of the fuse, a metal conducting tube attached to the other end of the fuse, an arcing rod, a spring biasing the arcing rod for movement, a fusible element connected to one end of the arcing rod; an improvement comprising:

a contact bridge having a center portion, said center portion having an opening through the center thereof, said contact bridge including arms projecting outwardly from said center portion, said arms being attached to the interior of the exhaust ferrule;

a contact element having a first end dimensioned to fit into said opening in said center portion, said contact element being attached to said contact bridge by swaging, said contact element having a second end extending from said contact bridge, said second end being connected to the fusible element.

7. An improvement, as claimed in claim 6, wherein said contact element further comprises an annular shoulder positioned intermediate the first and second ends, said shoulder dimensioned larger than said opening in said center portion so that said shoulder will engage said center portion when said first end is positioned in said opening.

8. An improvement, as claimed in claim 7, wherein said contact element has at least one groove formed adjacent the first end having a tapered surface adapted to cause said shoulder to be drawn against said center portion when said bridge is swaged.

9. An improvement, as claimed in claim 6, wherein said contact assembly further comprises a guide member formed on the first end of said contact element, said guide member being adapted to be engaged to position the contact element in the contact bridge before swaging, and to be broken off once the contact element is swaged to the contact bridge.

10. An improvement, as claimed in claim 6, wherein said arms have threads formed on projecting ends thereof that engage mating threads on the interior of the exhaust ferrule to attach said bridge to the ferrule.

11. An improvement, as claimed in claim 10, wherein said threads on said arms are forced radially outwardly when said contact bridge is swaged to enhance electrical connection with threads in said exhaust ferrule.

12. A contact assembly for a high voltage fuse comprising:

a bridge member having a center portion and including a pair of arms projecting outwardly from the center portion, said arms having means for engaging the interior of the fuse, said bridge member being positionable in the fuse so that compression of said center portion by a swaging process causes outward motion of said pair of arms so that said means for engaging the interior of the fuse is forced into intimate contact with the interior of the fuse.

* * * * *